US005752733A

United States Patent [19]

Marshall

[11] Patent Number: 5,752,733

[45] Date of Patent: May 19, 1998

[54] ADJUSTABLE STRAP ASSEMBLY FOR RAISING, LOWERING AND TRANSPORTING OUTBOARD MOTORS AND SIMILAR HEAVY BULKY OBJECTS; AND, METHODS OF USE THEREOF

[76] Inventor: Steven R. Marshall, 20627 Mainland View La. NE., Suquamish, Wash. 98392

[21] Appl. No.: 410,118

[22] Filed: Mar. 24, 1995

[51] Int. Cl.[6] ..... B65D 63/18; A45F 15/10

[52] U.S. Cl. ..... 294/154; 294/157; 294/165

[58] Field of Search ..... 294/74, 145, 149, 294/150, 153–157, 164, 165; 440/76, 77, 113; 150/157; 206/319

[56] References Cited

U.S. PATENT DOCUMENTS

| | | | |
|---|---|---|---|
| 181,492 | 8/1876 | Stevens | 294/154 |
| 217,350 | 7/1879 | Drake | 294/154 |
| 1,035,088 | 8/1912 | High | 294/154 |
| 2,498,113 | 2/1950 | Milner | 150/157 |
| 3,942,636 | 3/1976 | Matsuyama et al. | 206/349 |
| 4,114,838 | 9/1978 | Knauf | 224/45 |
| 4,317,257 | 3/1982 | Engel | 294/74 |
| 4,469,363 | 9/1984 | Kalla | 294/154 |
| 4,492,399 | 1/1985 | Randen et al. | 294/74 |
| 4,556,245 | 12/1985 | Gruenwald | 294/31 |
| 4,828,310 | 5/1989 | Schmidt, Jr. et al. | 294/153 |
| 5,102,178 | 4/1992 | Staats, Jr. | 294/157 |
| 5,137,481 | 8/1992 | Wengler | 440/77 |
| 5,147,079 | 9/1992 | Heather | 294/157 |
| 5,297,835 | 3/1994 | Wengler | 294/146 |

*Primary Examiner*—Dean Kramer
*Attorney, Agent, or Firm*—J. Robert Cassidy

[57] ABSTRACT

An adjustable strap assembly for raising, lowering and transporting outboard motors and similar heavy bulky objects, and methods of use thereof, wherein the adjustable strap assembly (20), in its preferred embodiment, requires only a handle (31) having a central tubular portion (42), a single strap (46) of nylon webbing or the like oriented in a figure-8 configuration with the material of the strap (46) passing through the tubular central portion of the handle twice (46', 46") so as to form an assembly having a first strap loop (32) on one side of the handle (31) devoid of fasteners and a second strap loop (34) on the opposite side of the handle (31) formed by coupling together the first and second free ends (58, 60) of the strap (46) using a suitable buckle assembly (61). In a slightly modified embodiment (FIG. 12), a second strap (82) is employed for surrounding the columnar motor leg (26') of an outboard motor (21') and for capturing and retaining the rear strap loop (34) with the second strap (82) employing a pair of closed through loops (84) at its opposite ends and wherein the first free end (58) of the strap (46) is fed downwardly through one of the second straps through loops (84) and upwardly through the other of the second strap's through loops (84) prior to coupling thereof to the buckle assembly (61) mounted on the second free end (60) of the strap (46).

17 Claims, 8 Drawing Sheets

35
31
44
46"
38
46'
36
41
56
50
40
49
35
45
55
51
50
44
31
42
36
41
50
39
38
58
46
59
48
54
51
52
50

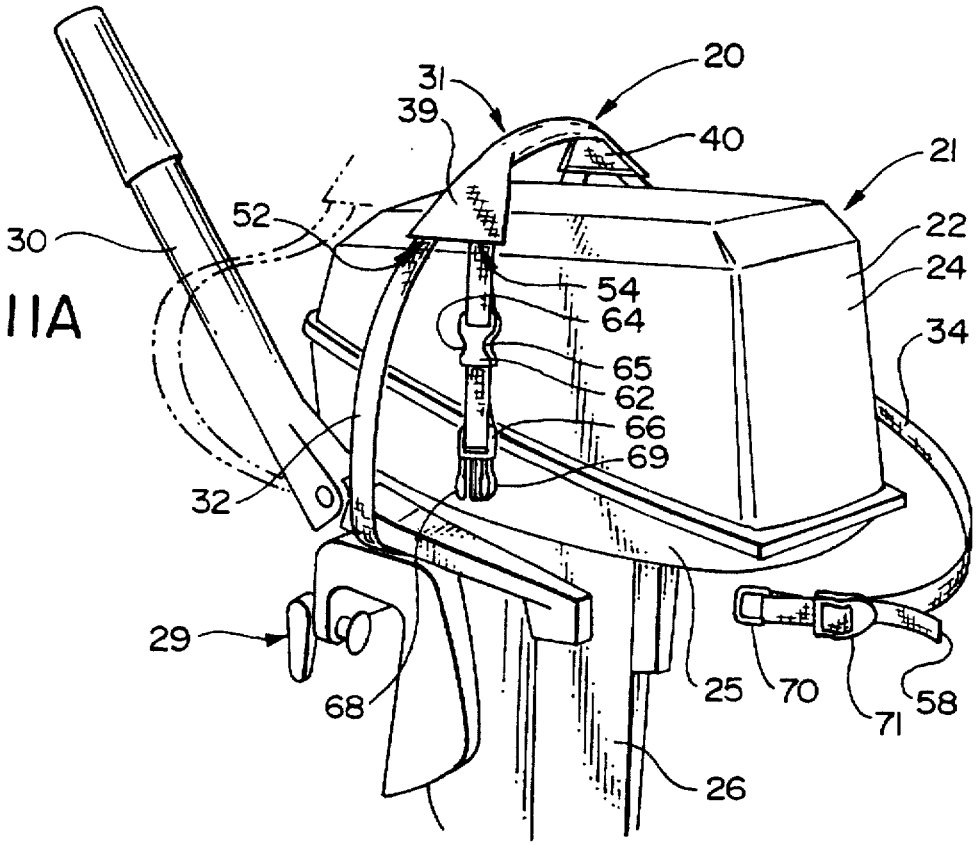
FIG. 11A
FIG. 11B
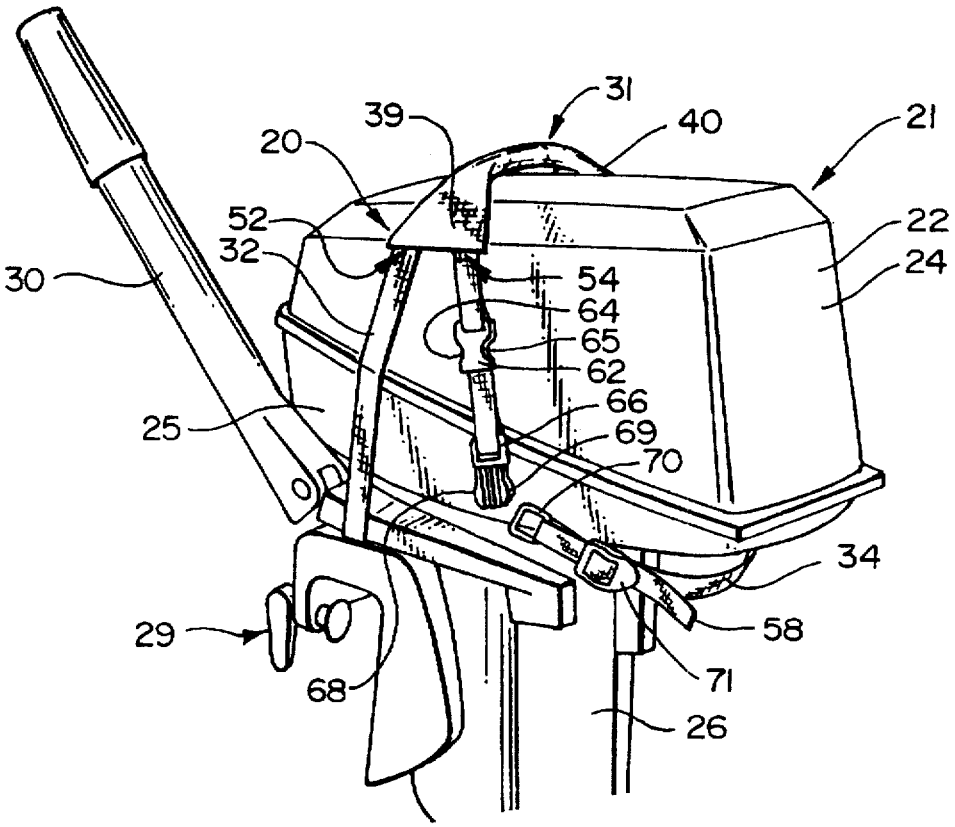

ADJUSTABLE STRAP ASSEMBLY FOR RAISING, LOWERING AND TRANSPORTING OUTBOARD MOTORS AND SIMILAR HEAVY BULKY OBJECTS; AND, METHODS OF USE THEREOF

BACKGROUND OF THE INVENTION

1. Technical Field

The present invention relates generally to a simple, yet highly effective, adjustable strap assembly for raising, lowering and/or transporting outboard motors and/or similar heavy bulky objects, as well as to methods of use thereof; and, more particularly, to an adjustable strap assembly and methods of using same, all of the foregoing character, and preferably employing: i) a single strap formed of nylon webbing, or webbing formed of other suitable fabric or synthetic material, and arranged in a figure-8 configuration so as to define a first forwardly projecting loop and a second rearwardly projecting loop with one of the first and second loops being devoid of fasteners; ii) a handle having a hollow tubular central portion through which the cross-over in the figure-8 configured strap passes; and iii), a buckle mechanism attached to at least one of the free ends of the strap so that the strap's free ends can be releasably, but adjustably and fixedly, secured together to define one of the first and second loops of the adjustable strap assembly.

More specifically, the present invention relates to an adjustable strap assembly, and methods of use thereof, employing: i) a handle having a hollow tubular central portion; ii) an elongate web-like strap formed of nylon or similar high-strength, wear-resistant, fabric material and having first and second free ends wherein the first free end of the strap is inserted into a first end of the hollow tubular central portion of the handle and out of the second end thereof with the first free end of the strap projecting out of the second end of the hollow tubular central portion of the handle being again inserted into the first end of the handle's hollow tubular central portion and out the second end thereof so that the portion of the strap intermediate the second end of the handle's hollow tubular central portion and the first end thereof defines a first continuous loop devoid of fasteners on the forward side of the handle; and iii), a buckle assembly fixedly attached to the second free end of the strap and releasably, yet fixedly and adjustably, attached to the first free end of the strap for forming a second continuous strap loop on the rearward side of the handle.

In the exemplary embodiment of the invention depicted in the drawings and hereinafter described in the ensuing Specification, the buckle assembly is preferably of the quick-release, snap-lock type having a female buckle member fixedly secured—for example, by appropriate stitching—adjacent to, but spaced several inches from, the second free end of the strap with the projecting second free end of the strap being passed through a securing ring on a bayonet-type male buckle member, folded back on itself, and secured to itself—again, preferably by suitable stitching. The opposite or first free end of the strap is preferably fed through any suitable rigid, closed, and preferably squared, ring formed of stainless steel or the like, folded back on itself, and fixedly, yet adjustably and removeably, secured to the main portion of the first free end of the strap by a conventional friction-type buckle element through which both the main portion of the first free end of the strap and the folded over portion thereof pass and are frictionally restrained against slippage. Thus, the arrangement is such that the bayonet-type male buckle member on the second end of the strap can be passed through the squared ring on the first end of the strap and snapped into the female buckle member to form a figure-8 configured strap having a first closed loop devoid of fasteners extending downwardly and forwardly from the handle and a second closed loop with an adjustable releasable buckle assembly extending downwardly and rearwardly from the handle.

When attaching the adjustable strap mechanism to, for example, a conventional outboard motor, the buckle assembly on the second closed loop portion is either loosened or unbuckled, and the first closed loop portion of the adjustable strap assembly is passed over the steering mechanism of the outboard motor and positioned snugly about the front end of the motor housing with the handle centered over the motor housing and substantially over the center of gravity of the outboard motor. The first free end of the strap is then pulled through the tubular portion of the handle so as to reduce the girth of the first closed loop, thereby cinching the strap into snug conformity about the front end of the motor housing. The first free end of the strap is then passed under the rear motor pan of the outboard motor housing; the bayonet-type male buckle member on the second free end of the strap is passed through the squared ring on the first free end of the strap and snapped into the female buckle member so as to complete the second continuous strap loop surrounding the rear end of the outboard motor housing; and, the first free end of the strap is pulled firmly through the friction-type buckle element so as to tighten the second loop in snug-fitting conformity about the rear portion of the outboard motor housing.

2. Background Art

Those skilled in the art will appreciate that the prior art is replete with a wide range of strapping mechanisms and the like for lifting, lowering, supporting and/or transporting a wide range of objects, including outboard motors. Perhaps the most pertinent of those known prior art devices is that disclosed in U.S. Pat. No. 5,137,481 issued on Aug. 19, 1992 to James J. Wengler.

The Wengler '481 patent discloses an adjustable strap mechanism termed an "Outboard Motor Tote" having a pair of longitudinally spaced apart straps 12 and 14 and a pair of separate independent buckles 20 with one buckle being attached at one end of each of the straps 12 and 14. The two longitudinally spaced apart straps 12 and 14 are passed in spaced apart relation through a fore/aft oriented handle 16 formed as a closed loop. The Wengler device as disclosed in the '481 patent is believed to suffer from several disadvantages including the fact that two separate and independent straps are provided, each of which has to be separately tightened down in snug conformity about respective ones of the front and rear ends of the motor housing and then buckled. Moreover, since there are two independent buckles—and the buckles generally comprise the most expensive component in this type of assembly—the Wengler construction involves significantly increased cost. Additionally, opening and closing of two separate buckles together with tightening of two separate straps in snug conformity about the motor housing involves a time consuming operation which is necessarily labor intensive. Finally, the Wengler structure as disclosed in the '481 patent is not particularly suited for use with some outboard motor designs wherein the vertical columnar motor leg surrounding the drive shaft of the outboard motor blends smoothly into the rear housing wall and the motor housing is substantially devoid of a generally horizontal rear motor housing pan about which the rear strap can be passed.

SUMMARY OF THE INVENTION

The present invention provides a simple, highly effective, and stable assembly, and methods of use thereof, which overcomes all of the disadvantages inherent in the arrangement disclosed in the Wengler '481 patent. Thus, only a single strap and a single buckle assembly are required, substantially reducing overall cost, facilitating placement of the continuous front loop of the figure-8 configured strap over the steering mechanism and in surrounding relation to the front end of the motor housing, and simplifying tightening of the front and rear loop portions in a single buckling operation. Moreover, the adjustable strap assembly of the present invention can be readily adapted to a wide range of outboard motors, including those having a streamlined fairing on the motor leg surrounding the drive shaft, which fairing blends smoothly into the rear of the motor housing without utilizing a generally horizontal rear motor pan about which the rear strap would normally be passed.

More particularly, the present invention is characterized by employing: i) a handle formed of flexible fabric material with or without a tubular stiffening element; ii) a single web-like strap formed of nylon fabric webbing or webbing formed of other suitable fabric or synthetic material characterized by its strength and wear-resistance, and wherein the first free end of the strap is passed through the handle's hollow tubular central portion (for example, from port to starboard), formed into a first front loop, and again passed through the handle's hollow tubular central portion in the same direction so as to form an arrangement in which an adjustably sized first loop is formed on the front side of the handle for surrounding the front portion of the motor housing in snug conformity therewith, while the two free ends of the strap—a single strap having two discrete portions crossed internally of the handle's hollow tubular central portion-project out of the opposite sides of the handle adjacent the rear portion of the motor housing; and iii), a buckle assembly is mounted on at least the second projecting free end of the strap for attachment to the first projecting free end of the strap to form a second adjustable strap loop extending rearwardly from the handle for surrounding the rear end of the motor housing in close snug-fitting conformity therewith.

In a more detailed embodiment of the invention, a second strap having starboard and port loops formed at its opposite ends may be provided for surrounding the streamlined fairing on the motor leg surrounding the motor's drive shaft with the first free end of the main strap passing, for example, downwardly through the starboard loop on the starboard side of the motor housing, upwardly through the port loop on the port side of the motor housing, and thence to the buckle assembly; thereby providing a strapping arrangement which effectively precludes the rear loop from sliding up the streamlined fairing in those instances where the outboard motor is substantially devoid of a generally horizontal rear bottom pan.

DESCRIPTION OF THE DRAWINGS

These and other objects and advantages of the present invention will become more readily apparent upon reading the following Detailed Description and upon reference to the attached drawings, in which:

FIG. 11A is a fragmentary isometric view similar to FIG. 1, here illustrating the first step in attaching the adjustable strap assembly of the present invention to a conventional outboard motor with the front loop portion of the strap here being shown in broken lines as it is passed over the steering mechanism of the outboard motor and in solid lines in loose surrounding relation to the front end of the motor housing;

FIG. 11B is a fragmentary isometric view similar to FIGS. 1 and 11A, here depicting the adjustable strap mechanism of the present invention with the handle being centered over the motor housing and substantially over the center of gravity of the outboard motor, the front loop of the adjustable strap in snug conformity to the front end of the motor housing, and the first free end of the strap in the process of being looped about and under the rear end of the motor housing in readiness for attachment to, and buckling of, the buckle mechanism;

Figure 1:
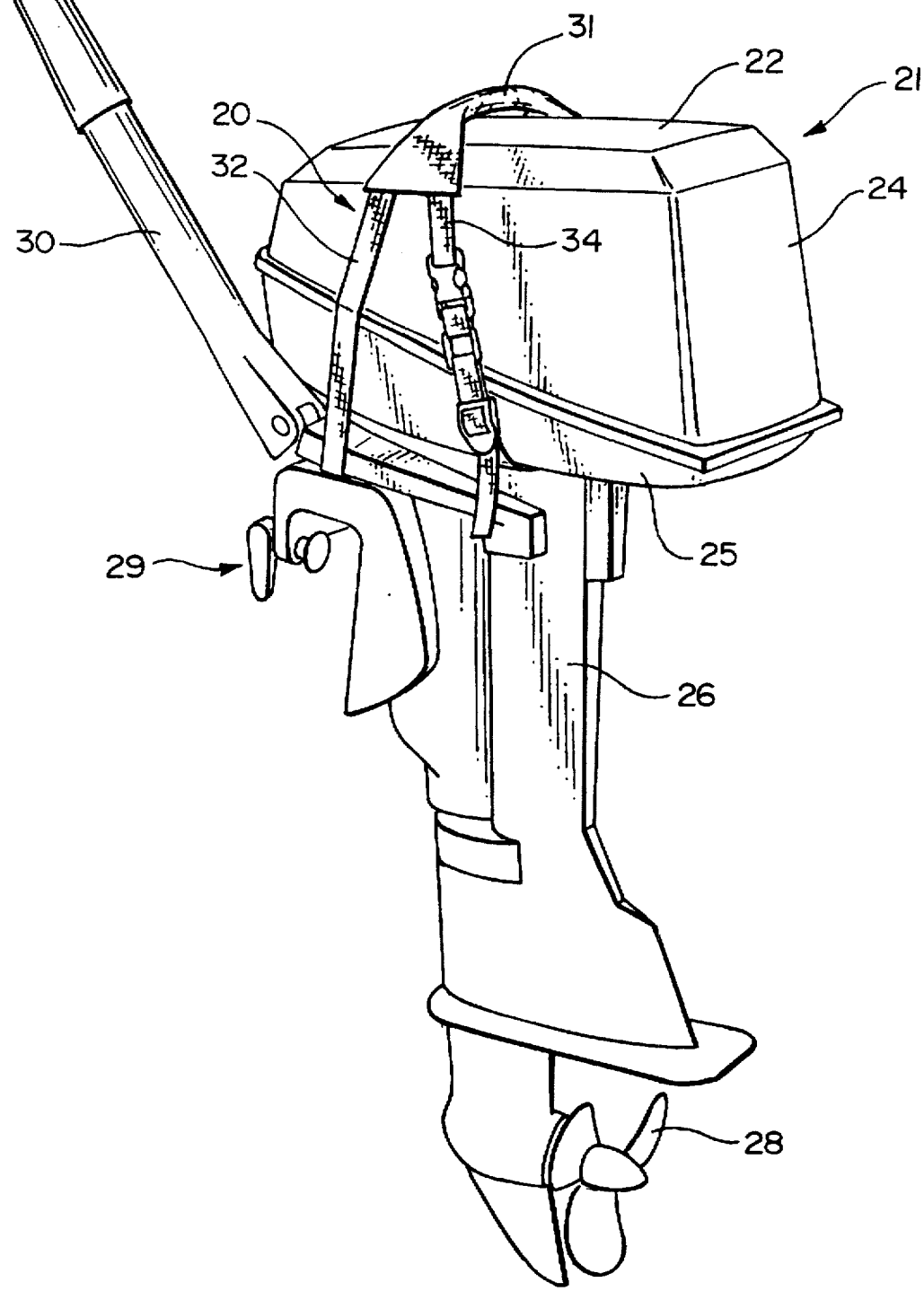
FIG. 1 is an isometric view taken from a port rear quarter perspective, here depicting an adjustable strap assembly embodying features of the present invention mounted on a conventional outboard motor.

While the invention is susceptible of various modifications and alternative forms, specific embodiments thereof have been shown by way example in the drawings and will herein be described in detail. It should be understood, however, that it is not intended to limit the invention to the particular forms disclosed; but, on the contrary, the intention is to cover all modifications, equivalents and/or alternatives falling within the spirit and scope of the invention as expressed in the appended claims.

DETAILED DESCRIPTION

Figure 2:
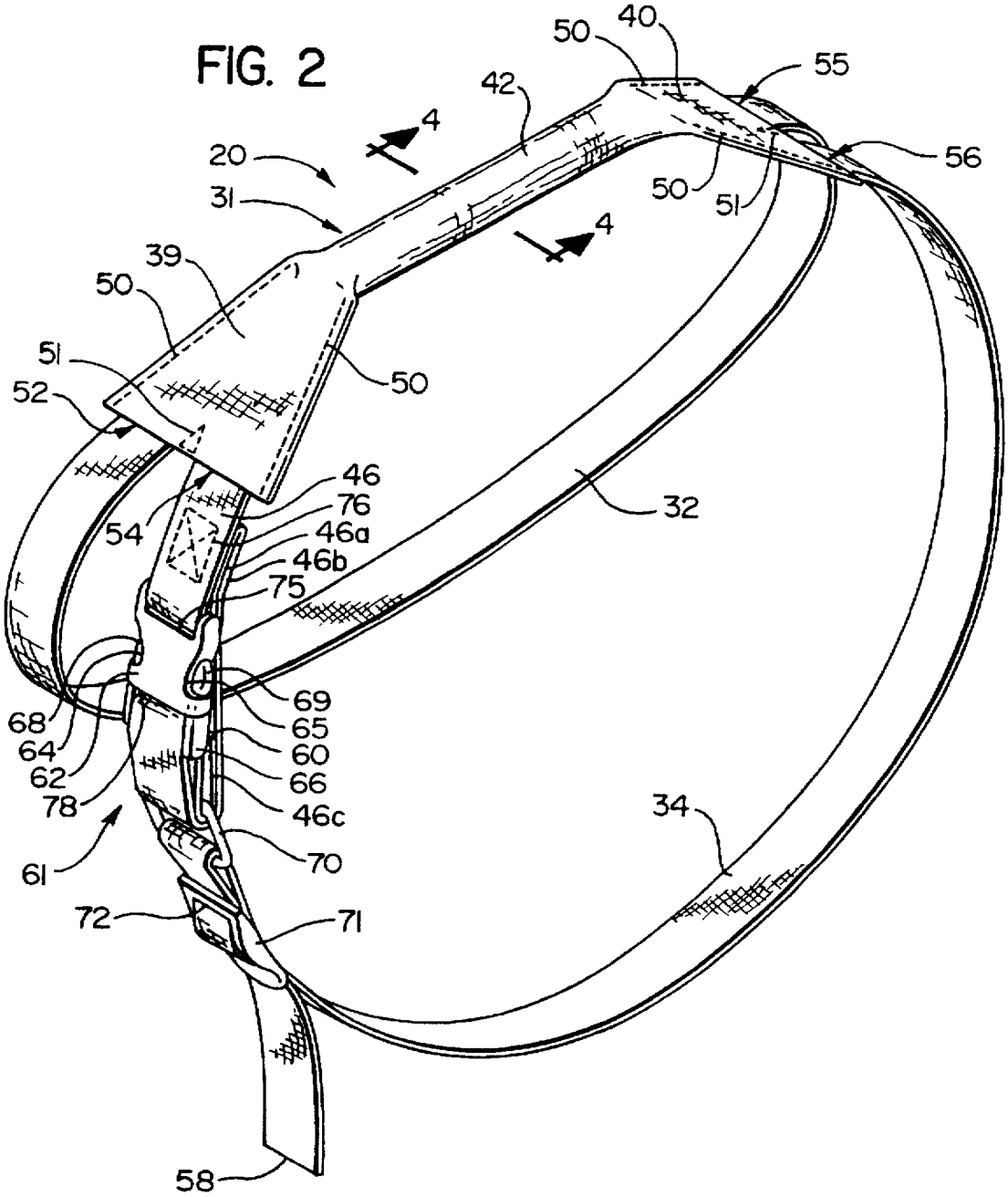
FIG. 2 is an isometric view of the assembled strap assembly and its handle, here depicting the strap assembly with the outboard motor removed for purposes of clarity.

Turning now to the drawings, and directing attention first to FIGS. 1 and 2 conjointly, an adjustable strap assembly, generally indicated at 20, embodying features of the present invention has been illustrated; and, has been depicted in FIG. 1 as it might be attached to a load to be raised, lowered and/or transported such, for example, as a conventional outboard motor, generally indicated at 21. As here illustrated, the conventional outboard motor 21 includes a motor housing 22 comprising an upper housing member or cover 24 and a lower or bottom housing member 25 with a downwardly extending columnar motor leg 26 housing the motor's drive shaft (not shown) which is coupled to a propeller 28 through suitable gearing (not shown). As is conventional with outboard motors of the type here depicted, the motor 21 is provided with: i)a suitable clamp assembly, generally indicated at 29, for removeably, but fixedly, attaching the outboard motor to the transom of a dingy, sailboat or other small boat or vessel (not shown); and ii), a steering mechanism 30 for turning the outboard motor 21 about a generally vertical axis to enable steering of the boat in any desired direction.

As will be noted upon inspection of FIG. 1, the adjustable strap assembly 20 includes a handle 31 extending transversely over the upper housing member 24 from port to starboard and a pair of front and rear depending loops 32, 34, respectively, of strap webbing coupled to the handle 31 with the strap loops 32, 34 circumscribing the girth of the motor housing 22 about respective one of the front and rear end portions thereof. As the ensuing description proceeds, it will become apparent to persons skilled in the art that the particular material(s) from which the handle 31 and strap loops 32, 34 are made is (are) not critical to the present invention provided only that such materials are characterized by their: lightness in weight; flexibility; strength; resistance to wear, loading and environmental conditions—e.g., temperature, moisture including salt water, sunlight including ultraviolet rays, and similar environmental conditions—and that such materials are economical and cost effective. Excellent results have been achieved when the handle 31 is made from nylon sheet material and the strap webbing comprises one inch (1") nylon webbing of the type supplied by Hi Tex, Inc. of Woodinville, Wash. under Part Number N0015. However, other conventional woven fabric materials made of synthetic or natural fibers, or composites of both, are suitable provided only that they meet the foregoing desired criteria.

In use, when the adjustable strap assembly 20 is applied to an outboard motor 21 or other heavy, bulky load, as shown in FIG. 1, the handle 31 is preferably centered over the load to be raised, lowered or transported and, more specifically, approximately over the center of gravity thereof, thereby providing a convenient lift point for the user's hand should the user wish to manually manipulate and/or transport the load 21. Alternatively, the handle 31, when located relative to the load 21 as shown in FIG. 1, defines a convenient point for attachment of any suitable and conventional lift hook (not shown) associated with a pier mounted or boat/ship mounted davit, winch or the like (not shown), thereby facilitating raising, lowering and other movement of the load—for example, an outboard motor 21 which may typically weigh up to 75 pounds or more—between: i) a stowed position on board a boat, ship or on land; and ii), a deployed position where the load, such as an outboard motor 21, may be properly mounted on the transom of the boat (not shown) to be propelled thereby.

Figures 3, 4:
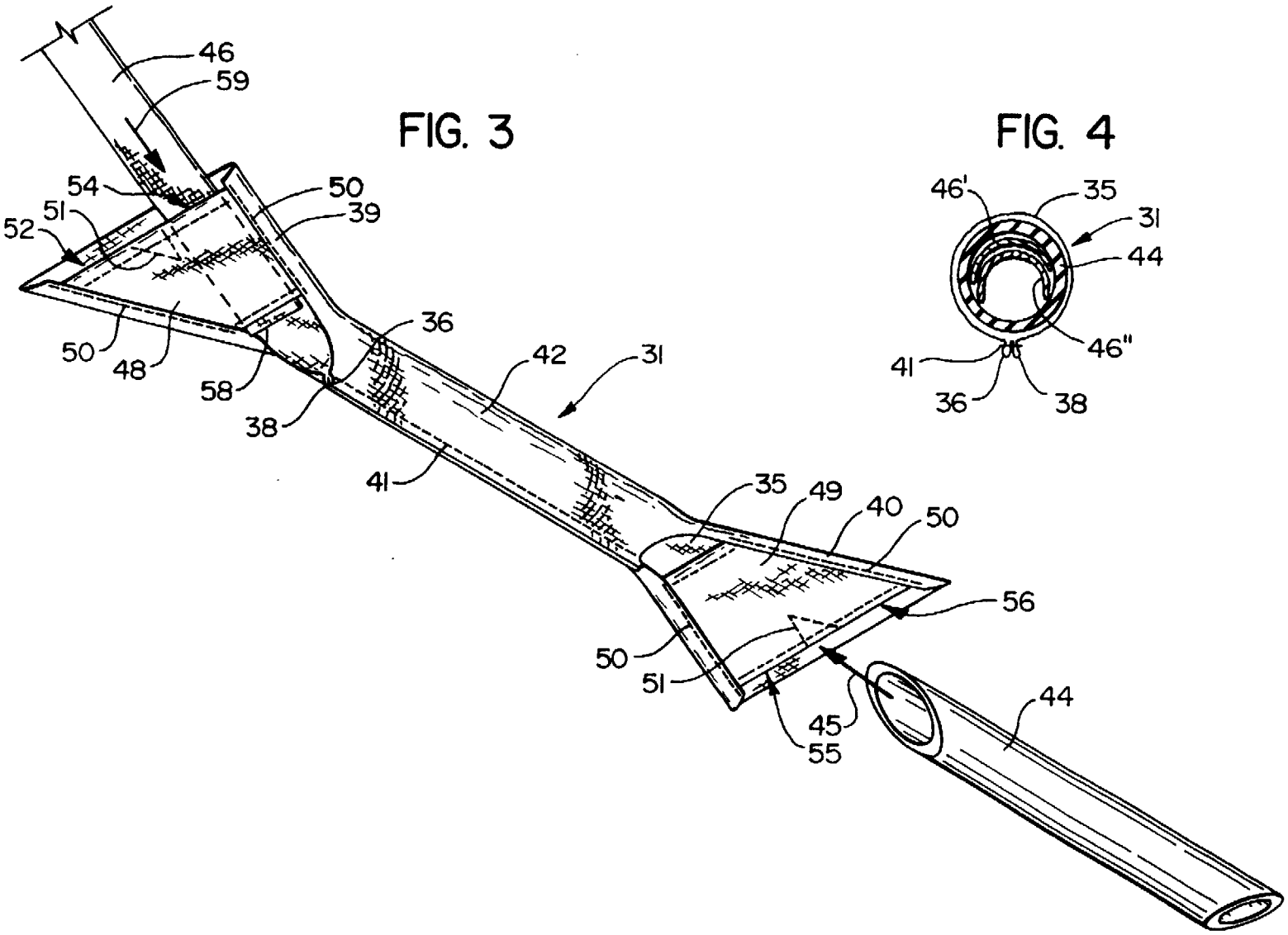
FIG. 3 is a fragmentary, partially exploded, isometric, bottom view of a handle embodying features of the present invention wherein the handle is made of fabric and is provided with an internal hollow tubular stiffener, and wherein the first free end of the web-like strap is positioned for insertion into and through the tubular portion of the handle.
FIG. 4 is a vertical sectional view taken substantially along the line 4—4 in FIG. 2, here depicting details of the assembled strap and handle assembly.

In carrying out the present invention, and as best illustrated in FIGS. 3 and 4, the handle 31 is preferably formed from a sheet 35 of nylon fabric material having a generally rectilinear central portion with opposed, parallel, longitudinally extending edges 36, 38 along the central or medial portion thereof, and terminating at each end in outwardly flared V-shaped portions 39, 40. In assembly, the opposed longitudinal edges 36,38 of the central or medial portion are folded over into face-to-face contact along their respective edges, and sewn together along a longitudinally extending stitch line 41 so as to define a flexible fabric handle 31 having a hollow tubular central portion 42 terminating at both ends in V-shaped flared extremities 39,40. If desired, the handle 31 may be strengthened and/or further supported by inserting any suitable tubular stiffener 44—the stiffener 44 is preferably formed of rigid or semi-rigid material such as plastic, rubber, metal, or the like—into the tubular central portion 42 of the fabric handle 31 in the manner illustrated by arrow 45 in FIG. 3.

To permit guidance of the nylon web 46 (or a web formed of other suitable fabric material) used to form the front and rear loop portions 32,34 of the adjustable strap assembly 20 into and through the tubular central portion 42—and through any tubular stiffener 44 that may be employed—of the handle 31, the left (port) and right (starboard) V-shaped flared extremities 39, 40 are each provided with a generally V-shaped trapezoidal sheet of fabric formed of nylon or the like as best indicated at 48, 49 in FIG. 3, with such sheets 48, 49 being complemental in shape with the V-shaped extremities 39, 40, and secured to respective ones of the V-shaped extremities 39,40 along edgewise stitch lines 50. To provide suitable guidance and maintain separation of the front and rear loop portions 32,34 of the nylon web 46 at the points of ingress and egress to and from the tubular central portion 42 of the handle 31, the trapezoidal sheets 48, 49 are further secured to respective ones of the V-shaped flared extremities 39, 40 by means of V-shaped stitch lines 51 defining: i) left front and left rear ingress points or channels, generally indicated at 52, 54, between the left flared portion 39 and the left trapezoidal sheet 48; and ii), right front and right rear egress points or channels, generally indicated at 55, 56, between the right flared portion 40 and the right trapezoidal sheet 49. Thus, the arrangement is such that a strap 46 formed of nylon webbing or other suitable fabric-like webbing may be inserted into the handle 31 for the adjustable strap assembly 20 in the manner indicated diagrammatically in FIG. 3—viz., the first free end 58 of the strap 46 is introduced into the left rear ingress channel 54 between the left V-shaped flared extremity 39 and the left trapezoidal sheet 48; and, is thereafter shifted therethrough (in the direction of arrow 59) and into and through the tubular central portion 42 of the fabric handle 31 as well as into and through any tubular stiffener 44 inserted therein.

Figure 5:
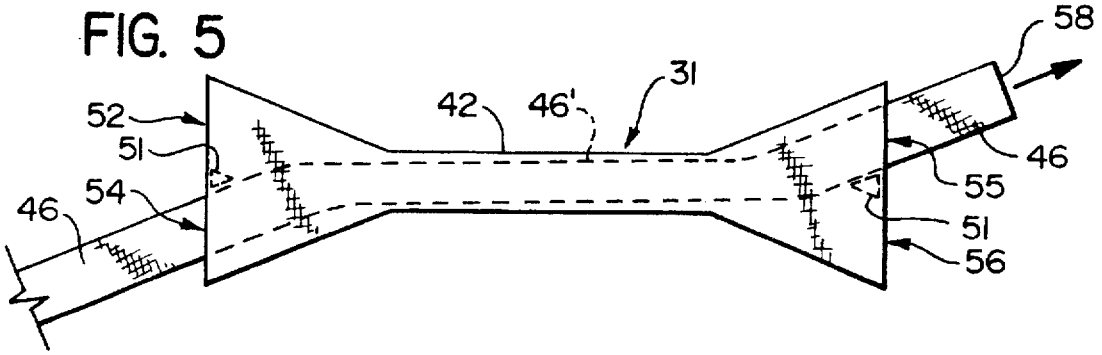
FIG. 5 is a fragmentary, diagrammatic drawing depicting assembly of the single strap of the present invention to the handle with the strap here having been shown as initially inserted into and through the hollow tubular portion of the handle from the left rear side of the handle with its first free end projecting laterally and forwardly from the right front side of the handle as viewed in the drawing.

In accordance with one of the important aspects of the present invention, the adjustable strap assembly 20 is formed of a single length of strap webbing 46 having a first free end 58 and a second free end 60 as best illustrated in FIGS. 2, 3 and 5 through 8; and, wherein the strap webbing 46 is fed through the tubular central portion 42 of the handle 31 twice so as to form: i) an adjustably sizable front strap loop 32 which is totally devoid of fastening elements; and ii), an adjustably sizable rear strap loop 34 having a buckle assembly—generally indicated at 61 in FIGS. 2 and 7 through 10, and described in greater detail below—for releasably and adjustably, yet fixedly, connecting the first free end 58 of the strap webbing 46 to the second free end 60 thereof so as to complete the adjustably sizable rear strap loop 34. To accomplish this, and as best illustrated by reference to FIGS. 3 and 5 through 7 conjointly, the first free end 58 of the strap webbing 46 is inserted into and through the left rear ingress channel 54 (FIG. 3), thence through the central tubular portion 42 of the fabric handle 31 (and through any tubular stiffener 44 that may be inserted therein), exiting from the handle 31 through the diagonally opposed right front egress channel 55—thus producing a first length 46' of strap webbing 46 passing through the handle 31—all as best shown in FIG. 5. Preferably a sufficient length of the strap webbing 46 is pulled through the handle 31 during this step so that the buckle assembly 61 mounted near the second free end 60 of the strap webbing 46 is pulled into close proximity to the left rear ingress channel 54, as best shown in FIG. 2.

Figure 6:
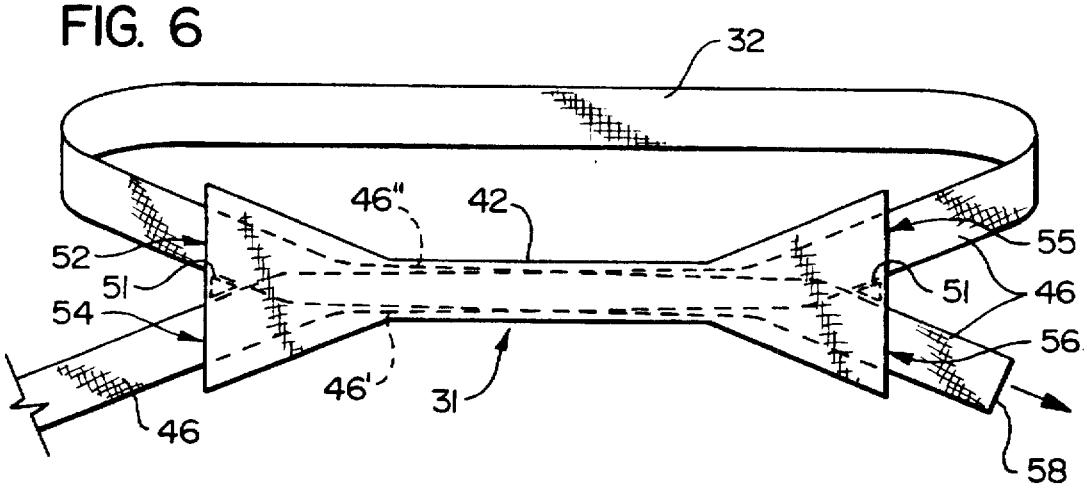
FIG. 6 is a fragmentary diagrammatic drawing similar to FIG. 5, but, here depicting the strap and handle assembly at that point where the first free end of the strap has been formed into a continuous, adjustably sizable, closed front loop with the first free end of the strap again inserted into the tubular portion of the handle—this time from the left front side thereof as viewed in the drawing—and projecting out of, and rearwardly from, the right rear side of the handle.

Thereafter, the leading portion of the strap webbing 46 which has exited from the right front egress channel 55 (FIG. 5) is then formed into an adjustably sizable front loop 32 with the first free end 58 of the strap webbing 46 being reinserted into the central tubular portion 42 of the handle 31 by introduction through the front left ingress channel 52 (FIG. 6) and with the first free end 58 of the strap webbing 46 exiting from the handle 31 through the diagonally opposed right rear egress channel 56—thus producing a second length 46" of strap webbing 46 passing through the handle 31, which second length 46" underlies, and is in face-to-face contact with, the first length 46' of strap webbing 46 initially passed through the handle 31, all as best shown by reference to FIGS. 4 and 6 conjointly. It will, of course, be appreciated from the foregoing description that since the first length 46' of strap webbing 46 passes through the handle 31 from a left rear ingress point 54 and exits from a diagonally opposed right front egress point 55, while the second length 46" of strap webbing 46 extends from a left front ingress point 52 to a diagonally opposed right rear egress point 56, the two lengths 46' and 46" of strap webbing 46 not only are in face-to-face contact as they extend through the hollow tubular central portion 42 of the handle 31 (FIG. 4.), but, in addition, they actually cross one another at the intersection of the two loops 32, 34 defined by the single strap of webbing 46 which is here deployed in a figure-8 configuration.

In carrying out this aspect of the invention, the exemplary buckle assembly 61, best illustrated in FIGS. 2 and 7 through 10, preferably comprises a combination of: i) a quick-release, snap-acting, female buckle member 62 having side detent openings 64, 65; ii) a bayonet-type male buckle member 66 having spring detents 68, 69; iii) a squared ring 70 preferably formed of stainless steel and preferably having an internal width which is slightly greater than the width of the strap webbing 46 but less than the maximum width of the male buckle member 62 and an internal diagonal measurement which is greater than the maximum width of the male buckle member 62; and iv), a friction-type buckle 71 having at least a pair of transverse spaced slots 72, 74 formed therein through which the first free end 58 of the strap webbing 46 can be threaded in both forward and reverse directions in the manner described in greater detail hereinbelow.

Those skilled in the art will appreciate that a wide variety of buckle devices are commercially available in the marketplace ranging from: i) simple buckles generally sold as items of wearing apparel having a rectangular frame at one end of a strap or belt and a pivoted latching element adapted to be selectively positioned in one of a series of spaced eyelets formed in the opposite end of the strap or belt such, for example, as a man's or woman's trouser belt; to ii), more sophisticated, multi-part, snap-acting buckle assemblies of the type here illustrated at 61. However, excellent results have been achieved in the practice of the present invention when using snap-acting, side-release female and male buckle components 62, 66 such, for example, as a TSR Side Release Buckle of the type manufacturer and marketed by ITW Nexus, an Illinois Tool Works Company of Wood Dale, Illinois under the Product Designator TSR100 and employing a SLICK CLICK™ latching system (SLICK CLICK is a trademark of ITW Nexus). Moreover, excellent results have been achieved using a friction-type buckle element 71 such, for example, as a LADDERLOC™ buckle (LADDERLOC is a trademark of ITW Nexus).

Figure 8:
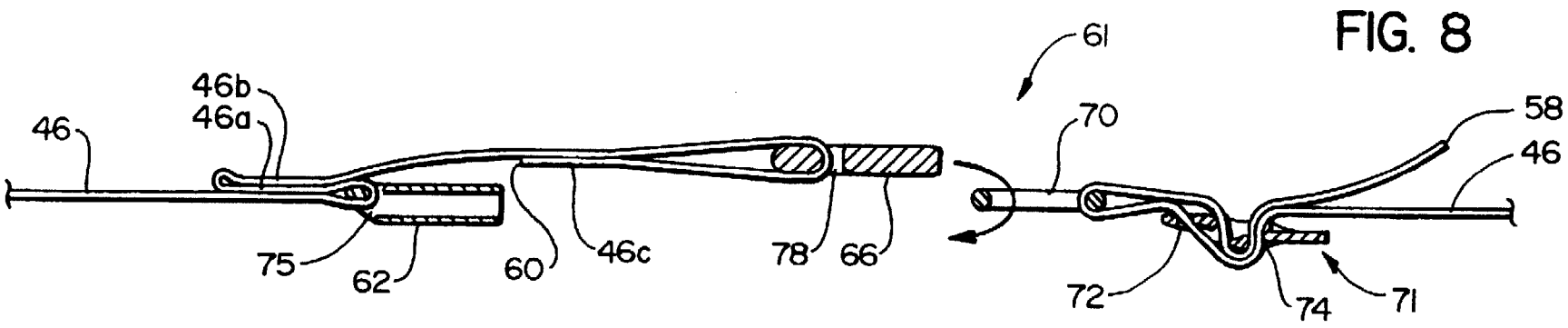
FIG. 8 is a vertical diagrammatic view, partially in section and taken substantially along the line 8—8 in FIG. 7, here depicting details relating to attachment of the buckle components to the strap.

Thus, when using a buckle assembly 61 of the foregoing character, and as best shown in FIG. 8, the buckle components are attached to the strap webbing 46 in the following manner:

A. The second free end 60 of the strap webbing 46 is passed through a transverse slot 75 formed in the female buckle member 62; folded backwardly on itself through an angle of 180° to form a first lamination 46*a*; again folded backwardly on itself through an angel of 180° to form a second lamination 46*b*, leaving approximately ten inches (10") of strap webbing 46 between the female buckle element 62 and the second free end 60 of the webbing 46; and, the three adjacent face-to-face laminations 46, 46*a* and 46*b* are then sewn together along stitch lines 76 (best shown in FIGS. 7 and 9–10), thus firmly securing the female buckle member 62 to the strap webbing 46 in proximity to, but spaced from, the second free end 60 thereof.

B. The projecting second free end portion 60 of the strap webbing 46—approximately ten inches (10") of webbing material—is then passed through a transverse slot 78 formed in the male buckle member buckle 66; folded backwardly on itself through an angle of 180° to form a lamination 46*c*; and, the two face-to-face laminations 46, 46*c* are sewn together adjacent the second free end 60 of the strap webbing 46 along stitch lines 79 (best shown in FIGS. 7 and 9–10).

C. The first free end 58 of the strap webbing 46 is passed through the slots 74, 72 in the friction-type buckle member 71; thence through the squared ring 70; folded back upon itself through an angle of 180°; and, again threaded through the slots 72, 74 in the friction-type buckle member 71 in face-to-face relation to the portion of the web 46 previously threaded in the opposite direction through the friction-type buckle member 71.

In order to assemble the buckle assembly 61 in buckled and locked relation, once the adjustable strap assembly 20 is positioned on the outboard motor 21, the portion of the strap webbing 46 extending through the right rear egress channel 56 (FIG. 7) is pulled in the direction of arrow 80 so as to reduce the girth of the front loop 32, thus cinching the front loop 32 about the front portion of the motor housing 22. The bayonet-type male buckle member 66 is then twisted through an angle of approximately 45°; passed diagonally through the opening in the squared ring 70; and, inserted into the female buckle member 62 with the spring detents 68, 69 respectively snapping into the detent openings 64, 65 in the female buckle member 62, thus securely locking the buckle assembly 61 in place. The portion of the strap webbing 46 passing through the friction-type buckle member 71 and the squared ring 70 is then pulled through the ring 70 to cinch the rear loop 34 tightly about the rear portion of the motor housing 22 (FIG. 1); and, the first free end 58 of the strap webbing 46 is pulled through the friction-type buckle member 71 in the opposite direction so as to tighten the overall adjustable strap assembly 20 about the outboard motor 21. The aggregate thickness of the two portions of the strap webbing 46 passing through the friction-type buckle member 71 serves to prevent inadvertent slippage of the adjustable strap assembly 20, insuring that the buckle assembly 61 remains tightly clamped.

In the event that the snap-acting, side-release buckle assembly 61 is either deliberately or inadvertently unlatched by inward depression of the spring detents 68, 69, the fact that the maximum width of the male buckle member 66 exceeds the internal transverse width of the squared ring 70 serves to preclude complete unhooking of the buckle assembly 61 unless and until the male buckle member 66 is twisted through an angle of approximately 45° so as to align itself with the maximum internal diagonal dimension in the opening passing through the squared ring 70.

Figure 9:
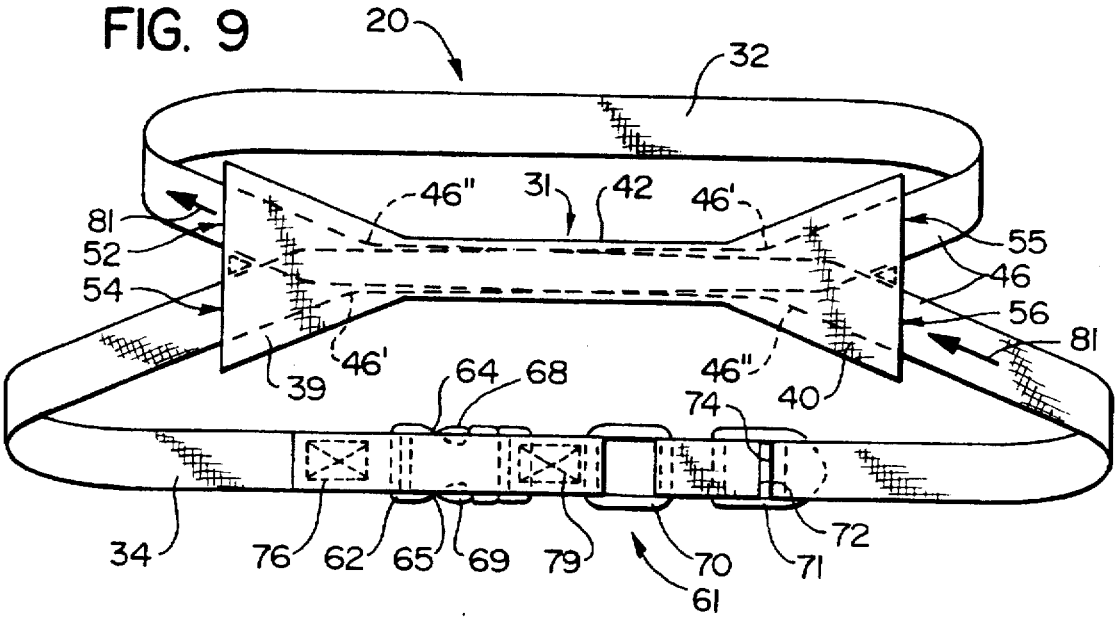
FIG. 9 is a diagrammatic drawing similar to FIG. 7, but with the first and second free ends of the strap buckled together, here illustrating how the first and second loops of the figure-8 configured strap can be adjusted in size by merely sliding one portion of the overlapped strap through the handle in the direction of the arrows so as to increase the size of the front loop while simultaneously decreasing the size of the rear loop by the same amount.
Figure 10:
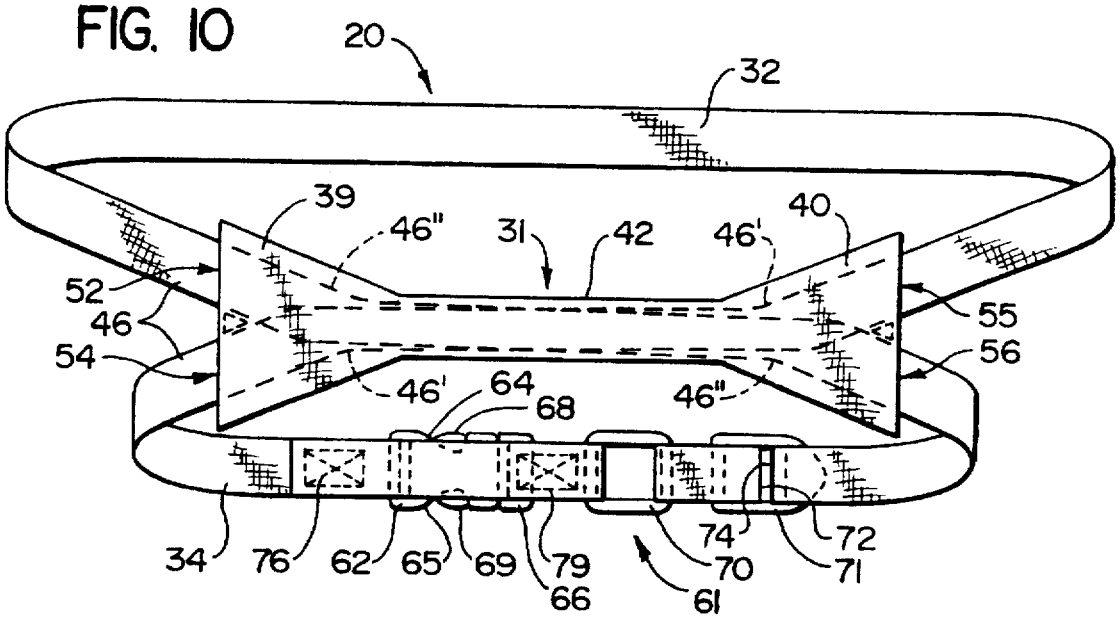
FIG. 10 is a diagrammatic drawing similar to FIG. 9, here illustrating the strap configured with a larger front loop and a smaller rear loop.

Referring next to FIGS. 9 and 10, it will be observed that the front strap loop 32, although totally devoid of buckle-type fasteners, is, nevertheless universally adjustable—i.e., the girth of loop 32 can be either reduced or increased merely by pulling the strap webbing 46 through the handle 31 in the proper direction. For example, if the strap webbing 46 is pulled outwardly through the left front ingress opening 52 in the direction of the arrow 81 (FIG. 9), the front loop 32 will be increased in girth while the rear loop 34 will be decreased in girth by the same amount, thereby producing loop sizes more comparable to those shown in FIG. 10 than in FIG. 9. Conversely, if the strap webbing 46 is pulled in the opposite direction out of the right rear egress opening 56, the front loop 32 will be decreased in size while the rear loop 34 will be increased in size by a like amount. And, of course, if the user wants to either increase or decrease the aggregate girth of the front and rear loops 32, 34, it is merely necessary to shift the first free end 58 of the strap webbing 46 in the proper direction through the friction-type buckle member 71.

Figure 7:
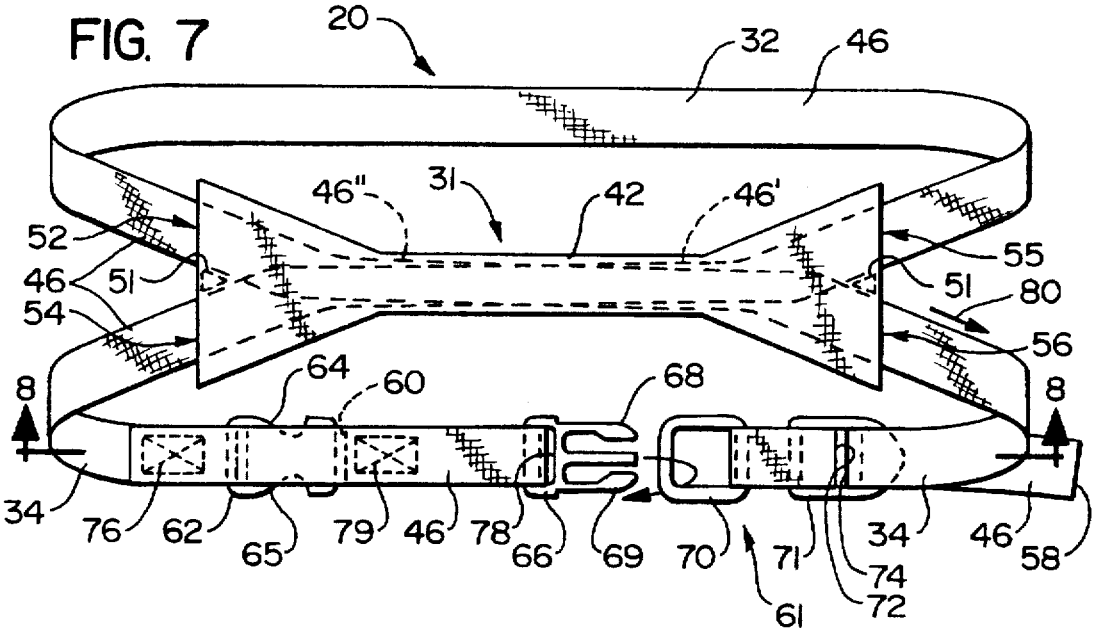
FIG. 7 is a diagrammatic drawing similar to FIGS. 5 and 6, here depicting the strap and handle fully assembled with the first and second free ends of the strap positioned in end-to-end relation in readiness for attachment of a snap-acting, bayonet-type, side-release buckle assembly so as to securely attach the first and second free ends of the strap together to form a second, adjustably sizable, closed, rearwardly extending loop.
Figure 11C:
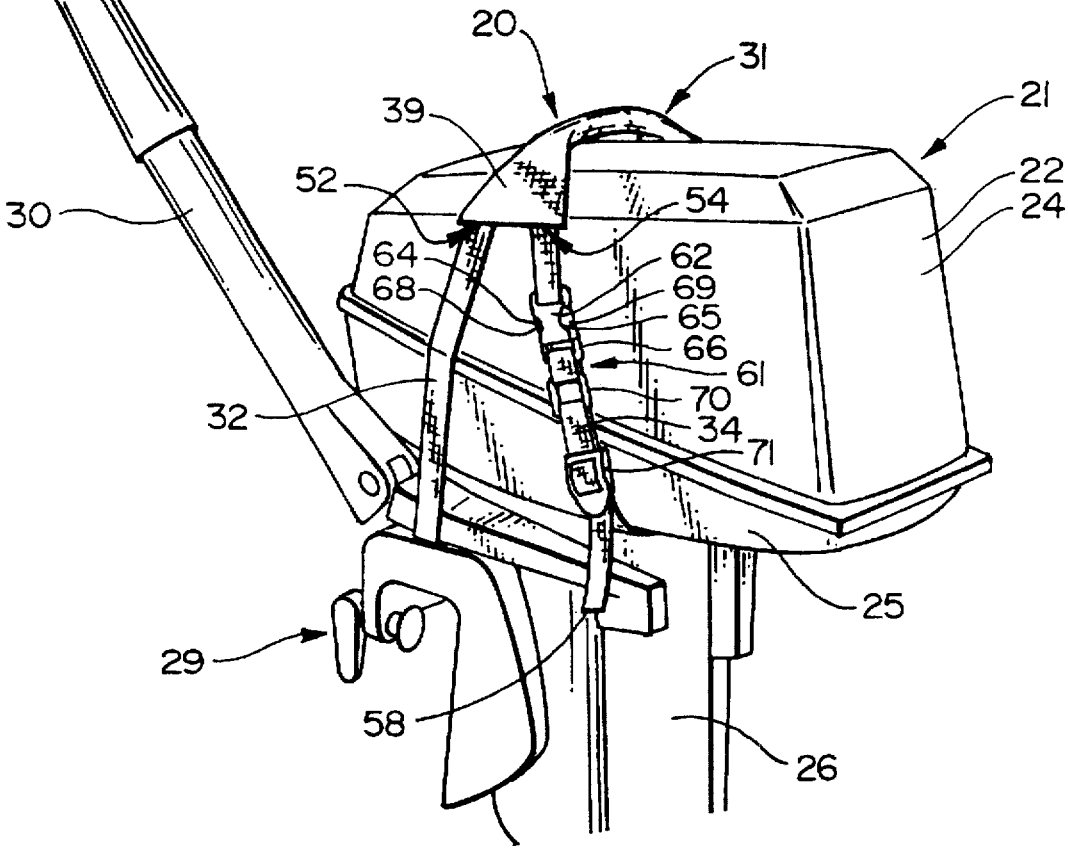
FIG. 11C is a fragmentary isometric view similar to FIGS. 1, 11A and 11B, here illustrating the assembled adjustable strap mechanism and handle with the rear loop of the strap being tightened and buckled and with both the front and rear loops being in snug conformity to the outer surface of respective ones of the front and rear portions of the motor housing; and, FIG. 12 is a fragmentary side elevational view somewhat similar to FIGS. 1, 11A, 11B and 11C, but here illustrating a modified form of the adjustable strap assembly of the present invention attached to a slightly different type of outboard motor having a streamlined fairing on the motor leg extending downwardly from the main motor housing and surrounding the motor's drive shaft with the modified strap mechanism including an additional strap connected on the port and starboard sides of the outboard motor to the rear loop of the figure-8 configured strap with the additional strap surrounding the vertical motor leg and preventing slippage of the rear loop upwardly over the streamlined fairing on the motor leg at the rear of the outboard motor.

Turning next to FIGS. 11A through 11C, the manner of applying the adjustable strap assembly 20 to a load such, for example, as an outboard motor 21 will be described. Initially, the buckle assembly 61 is either loosened or disconnected and the front loop 32 is adjusted to be somewhat overly large. The enlarged front loop 32 is then slipped over the steering mechanism 30 and loosely positioned about the front end of the motor housing 22 as shown in FIG. 11A. At this point, the handle 31 is centered over the motor housing 22 as shown in FIG. 11B; and, the strap webbing 46 is pulled rearwardly through the right rear egress channel 56 as shown in FIG. 7 to cinch the front loop 32 tightly about the front end of the motor housing 22 as shown in FIG. 11B. The first free end 58 of the strap webbing 46 is then pulled under the bottom pan below the rear portion of the bottom housing member 25 (See, FIG. 11B); the bayonet-type male buckle member 66 is twisted through an angle of 45° and inserted through the squared ring 70; the male buckle member 66 is then snapped into the female buckle member 62; and, finally, the first free end 58 of the strap webbing 46 is pulled through the friction-type buckle element 71 to tighten the strap and cinch it snugly about the rear end of the motor housing 22 as shown in FIG. 11C.

Figure 12:
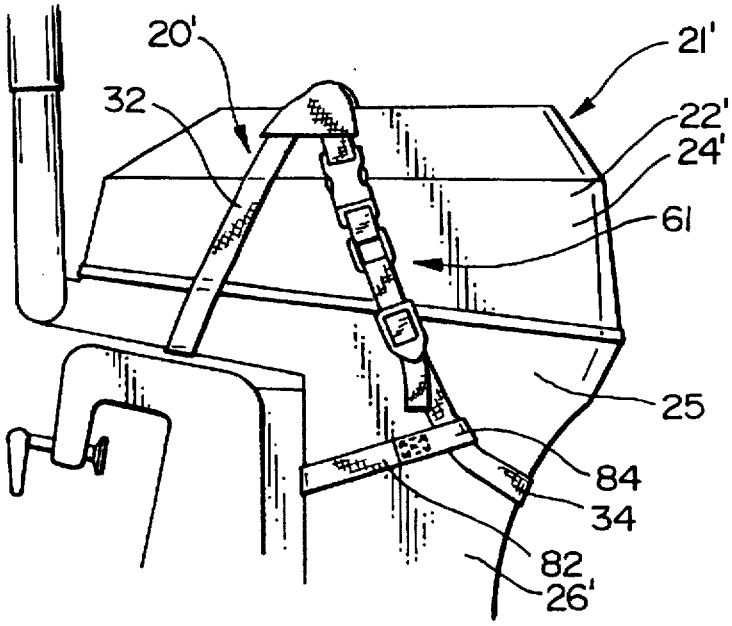

In accordance with another of the important objectives of the present invention, a slightly modified adjustable strap assembly 20' has been depicted in FIG. 12 for use with those versions of outboard motors 21' having a more streamlined fairing on the motor leg 26' surrounding the motor's drive shaft (not shown)—e.g., a fairing on motor leg 26' such as that depicted in FIG. 12 where the fairing blends smoothly into the rear wall of the lower or bottom housing 25', thus leaving no significant horizontal bottom pan at the rear of the motor 21' suitable for catching and retaining the rear loop 34 of the adjustable strap assembly 20'. To this end, a second strap 82 of nylon webbing or the like is provided having its opposite ends folded over through angles of 180° and sewn to the strap 82 to form closed through loops 84 at each end of the strap 82 (only the port strap loop 84 is isible in FIG. 12). In assembly, the first free end 58 of the main strap webbing 46, the friction-type buckle 71, and the squared ring 70 attached thereto, are passed downwardly through the one of the through loops 84 on the starboard side of the outboard motor 21' (such starboard through loop 84 is not visible in FIG. 12); the second or additional strap 82 is pulled around the front surface of the columnar motor leg 26' with its opposite through loop 84 being presented on the port side of the motor housing 22'; the first free end 58 of the main strap webbing 46 and the associated friction-type buckle 71 and squared ring 70 are passed upwardly through the port through loop 84; the main buckle assembly 61 is again snapped into locked condition in the manner previously described; and, the strap webbing 46 is again tightened by pulling the first free end 58 of the strap webbing 46 through the friction-type buckle member 71. The arrangement is such that the additional strap 82 serves to prevent the rear loop 34 of the adjustable strap assembly 20' from slipping upwardly over the outboard motor housing 22' despite the absence of a generally horizontal bottom pan at the rear of the motor 21'.

While the present invention has herein been illustrated and described in connection with an adjustable strap assembly 20 (20') wherein the strap webbing 46 is fed into the tubular handle 31 in sequence from a left rear ingress channel 54 and a left front ingress channel 52, exiting in sequence from a diagonally opposite right front egress channel 55 and a diagonally opposite right rear egress channel 56, resulting in an arrangement where the buckle assembly 61 occupies a position adjacent the left or port rear quarter of the outboard motor housing 22 (22'), those skilled in the art will appreciate that the invention, in its broadest terms, is not limited to the exemplary embodiment depicted and described. Rather, the port and starboard positions of the ingress and egress channels 52, 54 and 55, 56 can be interchanged from port to starboard and/or from front to rear, resulting in arrangements where the buckle assembly 61 resides on the starboard rear quarter, the port front quarter, or the starboard front quarter of the housing 22 without departing from the scope of the invention. However, where the invention is used with an outboard motor 21' of type depicted in FIG. 12, it is preferable that the buckle assembly 61 be located either on the port rear quarter of the housing 22' or on the starboard rear quarter thereof, thereby facilitating insertion of the first free end 58 of the strap webbing 46 through the port and starboard through loops 84 on the additional or second strap 82.

With regard to the handle 31 which extends transversely across the motor housing 22 (22') in accordance with the present invention, such an arrangement has been found to produce significant advantages when contrasted with a handle oriented in a fore/aft direction. For example, when the handle extends in a fore/aft direction, it has been noted that there is a tendency for the handle, when flexible as in the present invention, to bend excessively, cramping the fingers and/or hand of the user; and, to solve this problem, it has therefore been necessary to insert a rigid support into the handle to prevent such excessive flexure, an arrangement that is not necessary with the present invention since the transverse width of the housing 22 (22') is substantially less that is the distance measured from front to rear on the housing. Additionally, it has been found that usage of a transverse tubular handle though which the strap portions defining both the front and rear loops 32, 34 extend provides an arrangement where the upper portion of the loops approach one another at a sharp included angle, thereby preventing slippage of the lower portions of the loops 32, 34 and enhancing stability of the adjustable strap assembly 20 (20').

While the present invention is not limited to the particular type of buckle assembly 61 employed, usage of a snap-acting, side-release buckle having female and male buckle members 62, 64 in combination with a squared ring 70 produces some significant advantages not generally anticipated. For example, when not using a squared ring 70, it has been found that the female/male buckle components 62/66 have a tendency to unintentionally slip open when subjected to loads as little as 180 pounds; but, when the female/male buckle components 62/66 are used in combination with a squared ring 70 in the manner illustrated and described herein, it has been found that the buckle components 62, 66 remain firmly latched together despite being subjected to loads up to 580 pounds. Moreover, the exemplary buckle assembly 61 as shown and described herein has proven highly effective despite the fact that minimal stitching or sewing is required as contrasted with prior art strap assemblies of the type shown in the aforesaid Wengler '481 patent.

Thus, those skilled in the art will appreciate that there have herein been described simple, practical and economical, yet highly effective, adjustable strap assemblies 20, 20', and methods for use thereof, for raising, lowering and/or transporting heavy, bulky loads such, for example, as outboard motors 21, 21' irrespective of the shape of the motor housing 22, 22'. In its preferred embodiment, the adjustable strap assembly 20 requires only a single strap 46 of nylon webbing or the like which is configured in a figure-8 arrangement, defining an adjustably sizable first loop 32 devoid of buckles, fasteners, or the like and an adjustably sizable second loop requiring but a single buckle assembly 61 and wherein both loops 32, 34 can be either enlarged in girth or reduced in girth on an independent basis. In a slightly modified embodiment (FIG. 12), a second strap 82 is employed for surrounding the columnar motor leg 26' and for capturing and retaining the rear loop 34, preventing it from slipping upwardly over the smooth, streamlined, generally vertical surface at the rear of the motor housing 22' when the adjustable strap assembly 20' is employed on certain outboard motors 21' having a streamlined rear fairing eliminating the presence of a generally horizontal pan at the rear of the bottom housing member 25'.

I claim:

1. An adjustable strap assembly for raising, lowering or transporting a heavy bulky object, said adjustable strap assembly comprising, in combination:

a) an elongate strap having first and second free ends;

b) means defining a buckle assembly mounted adjacent said second free end of said strap;

c) a support handle having a hollow tubular central portion terminating in first and second end portions comprising generally V-shaped flared extremities defining fore and aft ingress channels converging towards, and communicating with, said hollow tubular portion at said first end portion of said handle and fore and aft egress channels converging towards, and communicating with, said hollow tubular portion at said second end portion of said handle;

d) said first free end of said strap extending through one of said fore and aft ingress channels and through said hollow tubular portion of said handle, exiting therefrom through the diagonally opposite one of said fore and aft egress channels, with said buckle assembly defining means and said second free end of said strap being in proximate relation to said first end portion of said handle;

e) said first free end of said strap extending from the diagonally opposite one of said fore and aft egress channels at said second end portion of said handle being looped about and reinserted into said first end portion of said handle through the other of said fore and aft ingress channels and extending through said hollow tubular portion of said handle, and again exiting from said second end portion of said handle through the diagonally opposite other one of said fore and aft egress channels to form a first strap loop intermediate said second end portion of said handle where said first free end of said strap first exits and said first end portion of said handle where said first free end of said strap is reinserted into and through said handle with said first strap loop being adjustable in size by pulling the portion of said strap passing through said tubular handle which is closest to said first free end of said strap in a desired direction towards one of said first and second end portions of said handle, and wherein the two portions of said strap passing through said hollow tubular portion of said handle cross one another interiorly of said handle; and, f) said first free end of said strap being passed through, and adjustably coupled to, said buckle assembly defining means on said second free end of said strap for forming a second strap loop extending from said second end portion of said handle to said buckle assembly adjacent to said first end portion of said handle so that when said first free end of said strap is coupled to said buckle assembly defining means on said second free end of said strap, said strap is oriented in a figure-8 configuration with said first strap loop devoid of fastener elements and said second strap loop having but a single buckle assembly defining means, thereby permitting adjustment of both said first and second strap loops using only said single buckle assembly defining means;

whereby said first strap loop can be positioned about a first end of a heavy bulky object in circumscribing relation thereto and cinched into tight conformity about the first end of the object by pulling on said first free end of said strap with said handle positioned approximately over the center of gravity of the object; and, wherein said second strap loop circumscribes a second end of the object and is cinched into snug conformity therewith by pulling said first free end of said strap through said buckle assembly defining means.

2. An adjustable strap assembly as set forth in claim 1 wherein said strap and said handle are formed of woven fabric material.

3. An adjustable strap assembly as set forth in claim 2 wherein said hollow tubular central portion of said handle includes a hollow lineal tubular support formed of one of a rigid and semi-rigid support material.

4. An adjustable strap assembly as set forth in claim 1 wherein said buckle assembly defining means includes a snap acting, side-release, detent-operated, buckle assembly including a female buckle member with detent openings formed therein and a male buckle member with spring detents formed thereon.

5. An adjustable strap assembly as set forth in claim 4 wherein said buckle assembly defining means further includes a friction-type buckle member and a rigid squared ring; and, said second free end of said strap is passed through said female buckle member, folded back upon itself through a first angle of 180°, and folded back upon itself through a second angle of 180° to form three face-to-face laminations of strap material spaced from said second free end of said strap; said three face-to-face laminations are fixedly secured together; said second free end of said strap is passed through said male buckle member, folded back upon itself through an angle of 180° into face-to-face contact with itself defining two laminations of strap material; said two laminations of strap material are fixedly secured together; said first free end of said strap is passed in one direction through said friction-type buckle member, through said rigid squared ring, and back through said friction-type buckle member in the opposite direction; whereby said buckle assembly defining means are connected together by passing said male buckle member and said second free end of said strap through said rigid squared ring, inserting said male buckle member into said female buckle member, and said strap is tightened about the object to be raised, lowered or transported by pulling said first free end of said strap through said friction-type buckle member.

6. An adjustable strap as set forth in claim 5 wherein the width of said male buckle member is greater than the transverse internal dimension of said squared ring but less than the diagonal internal dimension of said squared ring so as to preclude accidental total disconnection of said buckle assembly defining means.

7. An adjustable strap assembly as set forth in claim 1 wherein the object to be raised, lowered or transported includes a downwardly projecting structural element and said adjustable strap assembly includes a second strap having through loops formed at its opposite ends, said first free end of said elongate strap extends downwardly through one of said through loops on said second strap, said second strap being looped about the downwardly projecting structural element on the object to be raised, lowered or transported, and said first free end of said elongate strap extends upwardly through said through loop on the opposite end of said second strap and being thereafter coupled to said buckle assembly defining means; whereby, the downwardly projecting structural element on the object to be raised, lowered or transported is captured between said second strap loop and said second strap.

8. An adjustable strap assembly for raising, lowering or transporting an outboard motor, said adjustable strap assembly comprising, in combination:

a) an elongate strap having first and second free ends;

b) means defining a buckle assembly mounted adjacent said second free end of said strap;

c) a support handle having a hollow tubular central portion terminating in first and second end portions each comprising generally V-shaped flared extremities defining fore and aft ingress channels converging towards, and communicating with, said hollow tubular portion at said first end portion of said handle and fore and aft egress channels converging towards, and communicating with, said hollow tubular portion at said second end portion of said handle;

d) said first free end of said strap extending through one of said fore and aft ingress channels and through, said hollow tubular central portion of said handle with said first free end of said strap exiting from said hollow tubular portion of said handle through the diagonally opposite one of said fore and aft egress channels and extending outwardly from said second end portion of said handle and said buckle assembly defining means on said second free end of said strap being in proximate relation to said first end portion of said handle;

e) said first free end of said strap extending from said second end portion of said handle being looped about and reinserted into the other one of said fore and aft ingress channels in said first end portion of said handle and extending through said hollow tubular portion of said handle, exiting therefrom through the diagonally opposite other one of said fore and aft egress channels to form a first strap loop intermediate said second end portion of said handle where said first free end of said strap first exits and said first end portion of said handle where said first free end of said strap is reinserted into and through said other one of said fore and aft ingress channels in said handle with said first strap loop being adjustable in size by pulling the portion of said strap passing through said tubular handle which is closest to said first free end of said strap in a desired direction towards one of said first and second end portions of said handle with the two portions of said strap passing through said hollow tubular portion of said handle crossing one another interiorly of said handle; and, f) said first free end of said strap being passed through, and adjustably coupled to, said buckle assembly defining means on said second free end of said strap for forming a second strap loop extending from said second end portion of said handle to said buckle assembly adjacent to said first end portion of said handle so that when said first free end of said strap is coupled to said buckle assembly defining means on said second free end of said strap, said strap is oriented in a figure-8 configuration with said first strap loop devoid of fastener elements and said second strap loop having but a single buckle assembly defining means, thereby permitting adjustment of both said first and second strap loops using only said single buckle assembly defining means ;

whereby said first strap loop can be positioned about one of the forward and rear ends of an outboard motor in circumscribing relation thereto and cinched into tight conformity about the one end of the motor by pulling on said first free end of said strap with said handle extending transversely across the motor from port to starboard and being positioned approximately over the center of gravity of the motor; and, wherein said second strap loop circumscribes the other of the forward and rear ends of the motor and is cinched into snug conformity therewith by pulling said first free end of said strap through said buckle assembly defining means.

9. An adjustable strap assembly as set forth in claim 8 wherein said strap and said handle are formed of woven fabric material.

10. An adjustable strap assembly as set forth in claim 9 wherein said hollow tubular central portion of said handle includes a hollow lineal tubular support formed of one of a rigid and semi-rigid support material.

11. An adjustable strap assembly as set forth in claim 8 wherein said buckle assembly defining means includes a snap acting, side-release, detent-operated, buckle assembly including a female buckle member with detent openings formed therein and a male buckle member with spring detents formed thereon.

12. An adjustable strap assembly as set forth in claim 11 wherein said buckle assembly defining means further includes a friction-type buckle member and a rigid squared ring; and, said second free end of said strap is passed through said female buckle member, folded back upon itself through a first angle of 180°, and folded back upon itself through a second angle of 180° to form three face-to-face laminations of strap material spaced from said second free end of said strap; said three face-to-face laminations are fixedly secured together; said second free end of said strap is passed through said male buckle member, folded back upon itself through an angle of 180° into face-to-face contact with itself defining two laminations of strap material; said two laminations of strap material are fixedly secured together; said first free end of said strap is passed in one direction through said friction-type buckle member, through said rigid squared ring, and back through said friction-type buckle member in the opposite direction; whereby said buckle assembly defining means are connected together by passing said male buckle member and said second free end of said strap through said rigid squared ring, inserting said male buckle member into said female buckle member, and said strap is tightened about the outboard motor to be raised, lowered or transported by pulling said first free end of said strap through said friction-type buckle member.

13. An adjustable strap as set forth in claim 12 wherein the width of said male buckle member is greater than the transverse internal dimension of said squared ring but less than the diagonal internal dimension of said squared ring so as to preclude accidental total disconnection of said buckle assembly defining means.

14. An adjustable strap assembly as set forth in claim 8 wherein the outboard motor to be raised, lowered or transported includes a downwardly projecting motor leg and said adjustable strap assembly includes a second strap having through loops formed at its opposite ends, said first free end of said elongate strap extends downwardly through one of said through loops on said second strap, said second strap being looped about the downwardly projecting motor leg on the outboard motor to be raised, lowered or transported, and said first free end of said elongate strap extends upwardly through said through loop on the opposite end of said second strap and being thereafter coupled to said buckle assembly defining means; whereby, the downwardly projecting motor leg on the outboard motor to be raised, lowered or transported is captured between said second strap loop and said second strap.

15. A method of applying an adjustable strap assembly of the type including: i) a strap having first and second free ends; ii) a buckle assembly mounted on the strap adjacent the second free end thereof; and iii), a tubular handle having first and second ends each comprising generally V-shaped flared extremities defining fore and aft ingress channels converging towards, and communicating with, the tubular handle at the first end thereof and fore and aft egress channels converging towards, and communicating with, the tubular handle at the second end thereof, to a load for purposes of raising, lowering or transporting the load, said method comprising the steps of:

a) inserting the first free end of the strap into one of the fore and aft ingress channels and through the tubular handle from the first end thereof through the second end thereof with the first free end of the strap exiting from the second end of the tubular handle through the diagonally opposite one of the fore and aft egress channels;

b) pulling the strap through the tubular handle until the buckle assembly on the second free end of the strap is in proximate relation to the first end of the tubular handle;

c) reinserting the first free end of the strap into the other of the fore and aft ingress channels and through the tubular handle from the first end thereof through the second end thereof with the first free end of the strap exiting from the second end of the tubular handle through the diagonally opposite other one of the fore and aft egress channels with the two portions of strap passing through the tubular handle crossing one another interiorly of the tubular handle so as to form a first strap loop extending from the second end of the tubular handle to the point where the first free end of the strap is reinserted into the first end of the tubular handle during step (c);

d) positioning the first strap loop about one end of the load with the tubular handle approximately centered over the center of gravity of the load;

e) pulling the first free end of the strap through the tubular handle to cinch the first strap loop tightly about the one end of the load;

f) passing the first free end of the strap beneath a second end of the load;

g) coupling the first free end of the strap to the buckle assembly on the second free end of the strap to form a second strap loop circumscribing the second end of the load with the strap oriented in a figure-8 configuration with the first strap loop devoid of fastening elements and the second strap loop having but a single buckle assembly; and, h) cinching the second strap loop into snug conformity about the second end of the load by pulling the first free and of the strap through the buckle assembly.

16. The method as set forth in claim 15 wherein the load to be raised, lowered or transported comprises an outboard motor including a downwardly extending columnar motor leg.

17. The method as set forth in claim 16 wherein the adjustable strap assembly includes a second strap having closed through loops formed at its opposite ends and wherein during step (f) the first free end of the first named strap is passed downwardly through the closed through loop at one end of the second strap, the second strap is looped about the front of the downwardly projecting motor leg, and the first free end of the first named strap is passed upwardly through the closed through loop at the opposite end of the second strap and is thereafter coupled to the buckle assembly during step (g) so that the motor leg is captured between the second strap loop on the first named strap and the second strap.

* * * * *